US007238056B2

(12) United States Patent
McCoy

(10) Patent No.: US 7,238,056 B2
(45) Date of Patent: Jul. 3, 2007

(54) ELECTRICAL CONNECTOR

(75) Inventor: Phillip A. McCoy, Albion, IN (US)

(73) Assignee: Dekko Technologies, Inc., North Webster, IN (US)

( * ) Notice: Subject to any disclaimer, the term of this patent is extended or adjusted under 35 U.S.C. 154(b) by 0 days.

(21) Appl. No.: 10/962,946

(22) Filed: Oct. 12, 2004

(65) Prior Publication Data

US 2006/0079108 A1 Apr. 13, 2006

(51) Int. Cl.
*H01R 24/00* (2006.01)

(52) U.S. Cl. ..... 439/660; 439/851

(58) Field of Classification Search ..... 439/284, 439/851, 748, 660, 271, 35
See application file for complete search history.

(56) References Cited

U.S. PATENT DOCUMENTS

| | | | | |
|---|---|---|---|---|
| 1,943,590 A | | 1/1934 | Douglas | 173/328 |
| 2,597,338 A | | 5/1952 | Kohring | 201/67 |
| D178,775 S | | 9/1956 | Gombar | D26/1 |
| 3,096,393 A | | 7/1963 | Mancini | 174/68.5 |
| 3,281,760 A | | 10/1966 | Oshima et al. | 339/176 |
| 3,396,364 A | | 8/1968 | Bonhomme | 339/217 |
| 3,601,780 A | * | 8/1971 | Lyon et al. | 439/685 |
| 4,061,407 A | * | 12/1977 | Snow | 439/35 |
| 4,932,902 A | | 6/1990 | Crane, Jr. | |
| 4,979,915 A | * | 12/1990 | Pitts | 439/884 |
| 5,281,178 A | * | 1/1994 | Biscorner | 439/845 |
| 5,720,634 A | | 2/1998 | Sten | |
| 5,957,715 A | * | 9/1999 | Fukuda | 439/271 |

* cited by examiner

*Primary Examiner*—Tho D. Ta
*Assistant Examiner*—Vanessa Girardi
(74) *Attorney, Agent, or Firm*—Taylor & Aust, P.C.

(57) ABSTRACT

An electrical connector including a plurality of conductors, at least one male terminal electrically connected to at least one of the plurality of conductors, and at least one female terminal electrically connected to at least one of the plurality of conductors. At least one male terminal includes a cross-section defining at least one line contact. At least one female terminal is for electrical connection to at least one male terminal. At least one female terminal includes both a longitudinal split and an approximately circular cross-section.

10 Claims, 3 Drawing Sheets

ELECTRICAL CONNECTOR

BACKGROUND OF THE INVENTION

1. Field of the Invention

The present invention relates to an electrical connector, and, more particularly, to an electrical connector for a motorcycle rectifier.

2. Description of the Related Art

In an electrical connector with two parts where one connector part has at least one male terminal and the other connector part has at least one female terminal, a common problem when electrically connecting the two parts is contact resistance between corresponding male and female terminals. If the connector is part of a relatively high current circuit, the effect of contact resistance between corresponding male and female terminals is amplified according to Ohm's Law, i.e., the voltage drop across the terminal pair is the current through the terminal pair multiplied by the contact resistance between the terminal pair, assuming the terminals' resistance are negligible. The higher current thereby produces a higher voltage drop across the terminal pair. Concurrently, high contact resistance can act as a current limiting device which limits current to the electrical load connected to the electrical connector. The effect of reduced voltage and/or current to the electrical load can limit the performance of the electrical load, shorten the useful life of the electrical load and/or render the electrical connector essentially non-functioning.

Additionally, the heat generated by the electrical connector according to the equation $P=I^2R$ (where P is the heat loss by the connector, I is the current through the connector and R is the contact resistance) can start a negative spiral which ultimately leads to a failure of the connector. For example, the heat generated by the current through the connector and the contact resistance can breakdown the insulation associated with the connector. The heat generated by the electrical connector can also degrade the contact between connector terminals by accelerating corrosion, oxidation, pitting, etc., of the terminals dependent on environmental factors, and connector design and composition.

The contact resistance between two terminals in a connector is proportional to the resistivity of the current carrying materials of the terminals and inversely proportional to the contact area between the terminals. From these relationships it is desirable therefore to have as large of an area of the terminals in mutual contact and also have the area of the terminals in mutual contact free from relatively high resistivity materials such as metal oxides.

A known connector terminal design includes a barrel shaped female terminal and a rod shaped male terminal, both with circular cross-sections. Ideally, the entire inside surface of the female barrel is in contact with the entire outside surface of the male rod; however, this ideal surface contact is never realistically achieved. According to known design principles and achievable, cost effective manufacturing tolerances, the male rod when inserted into the female barrel tends to arrive at a three point mutual contact which has a very small mutual contact area. Further, the three points in contact when the male terminal begins insertion into the female terminal are different than the three points in contact when the male terminal is fully inserted into the female terminal. Stated differently, the three point mutual contacts between the male and female terminals can wander around the circumferences of the corresponding terminals. The final surfaces in mutual contact after complete insertion of the male terminal therefore have been subjected to minimal, if any, frictional forces that would tend to scrape away higher resistivity material surface layers associated with the terminals, such as a metal oxide surface layer.

What is needed in the art is an electrical connector with male/female terminal pairs which provide consistently low contact resistance and which are reliable and cost effective to manufacture.

SUMMARY OF THE INVENTION

The present invention provides an electrical connector with terminals which have a low contact resistance due to at least one line contact between the terminals.

The invention comprises, in one form thereof, an electrical connector including a plurality of conductors, at least one male terminal electrically connected to at least one of the plurality of conductors, and at least one female terminal electrically connected to at least one of the plurality of conductors. At least one male terminal includes a cross-section defining at least one line contact. At least one female terminal is for electrical connection to at least one male terminal. At least one female terminal includes both a longitudinal split and an approximately circular cross-section.

An advantage of the present invention is a lower contact resistance between corresponding male and female terminals.

Another advantage of the present invention is a lower contact resistance between corresponding male and female terminals due to an increased contact surface area between corresponding male and female terminals.

Yet another advantage of the present invention is a lower contact resistance between corresponding male and female terminals due to a removal of higher resistivity contact surface materials between corresponding male and female terminals.

Yet another advantage of the present invention is that it provides for at least one line contact between corresponding male and female terminals.

Yet another advantage is the present invention is reliable in service.

Yet another advantage of the present invention is that it is cost effective to manufacture.

Yet another advantage of the present invention is that it can endure repetitive insertion cycles without plastic deformation of either the male or female terminals.

Yet another advantage is the present invention is suitable for high current applications.

Yet another advantage of the present invention is that it is resistant to environmentally influenced conditions such as corrosion, oxidation, pitting, etc.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
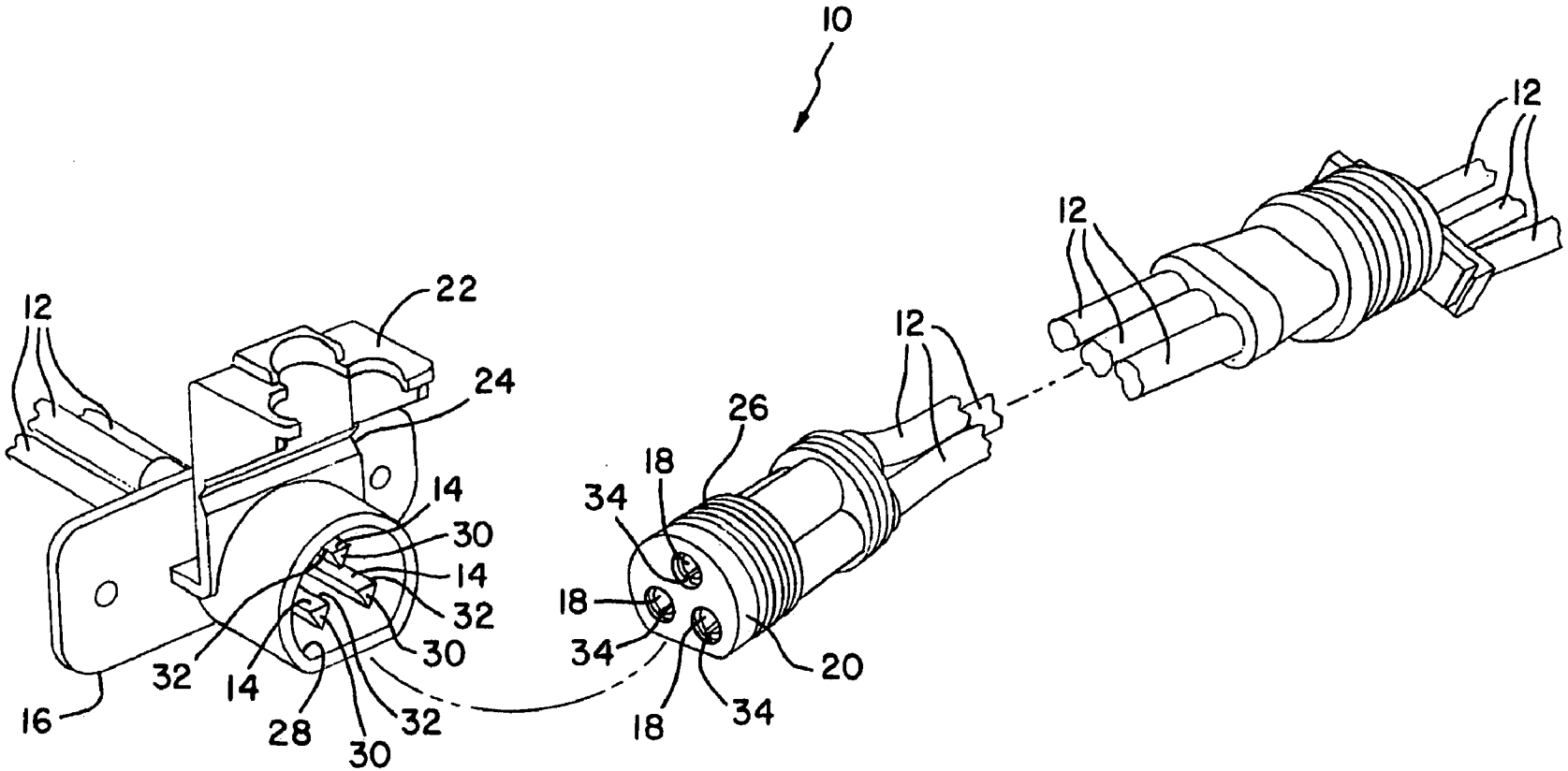
FIG. 1 is a perspective exploded view of an embodiment of the electrical connector of the present invention.
Figure 2:
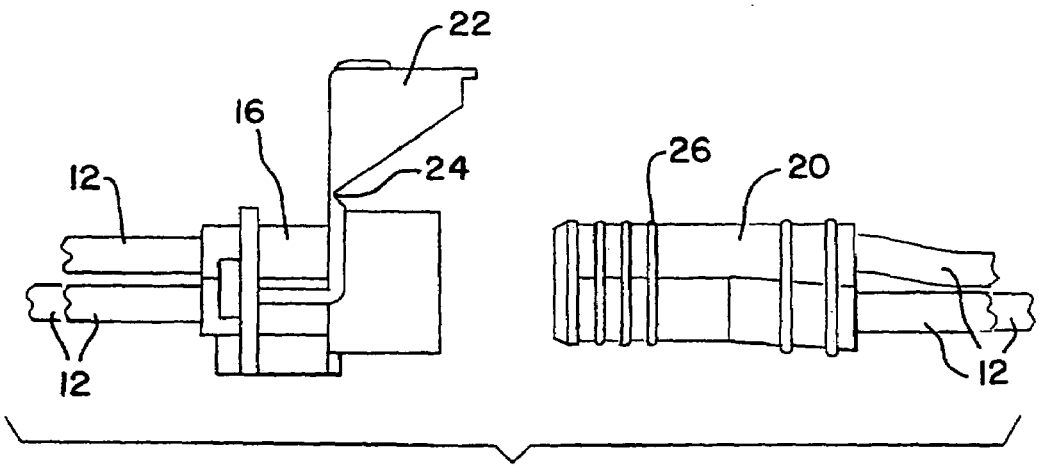
FIG. 2 is a partial exploded side view of the embodiment of FIG. 1.
Figure 3:
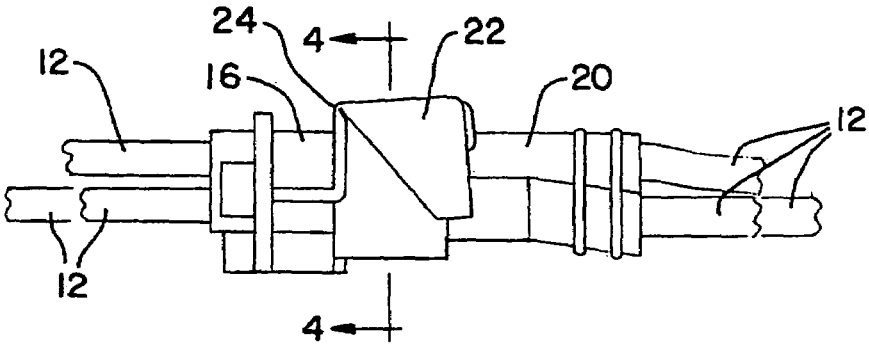
FIG. 3 is an assembled side view of the embodiment of FIG. 2.

Referring now to the drawings, and more particularly to FIG. 1, there is shown an electrical connector 10 which generally includes a plurality of conductors 12, at least one male terminal 14 associated with a first housing 16 and electrically connected to at least one of the plurality of conductors 12, and at least one female terminal 18 associated with a second housing 20 and electrically connected to at least one of the plurality of conductors 12. Female terminals 18 are configured for electrical connection to male terminals 14. A male terminal 14 and a corresponding female terminal 18 comprise an electrical terminal pair.

Conductors 12 typically may have an insulation associated therewith.

First housing 16 includes connector lock 22 with living hinge 24. Connector lock 22 helps maintain the interconnection of first housing 16 and second housing 20, when the two housing are mated and connector lock 22 is depressed over second housing 20, thereby helping to maintain electrical connection between terminals 14, 16. Second housing 20 includes ribs 26 which mate with inner contour 28 of first housing 16 to form a seal between first housing 16 and second housing 20, thereby helping to protect terminals 14, 16 from adverse environmental conditions.

Figure 4:
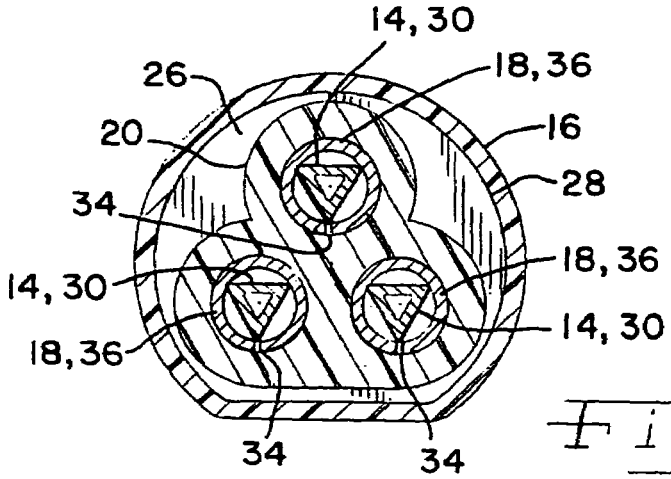
FIG. 4 is a cross-sectional view taken along 4—4 in FIG. 3.

At least one of male terminals 14 includes a cross-section 30 defining at least one line contact 32. Male terminal's cross-sections 30 are shown as being triangular cross-sections although other cross-sectional shapes such as planar or other polygonal (regular or otherwise) shapes are possible. The triangular cross-sections 30 provide each of male terminals 14 with three line contacts 32, where each line contact 32 is coincident with a corresponding vertex of a corresponding triangular cross-section 30, and extends substantially and/or completely along the length of a corresponding male terminal 14. At least one female terminal 18 includes both a longitudinal split 34 and an approximately circular cross-section 36 (FIG. 4). A longitudinal split 34 extends substantially and/or completely along the length of a corresponding female terminal 18. In the embodiment shown, male terminals 14 form a triangular pattern as best seen in FIG. 4, although other geometric patterns are possible depending on the number of male terminals. The triangular pattern is comprised of one male terminal 14 at each vertex of the triangular pattern. Similarly, female terminals 18 form a corresponding triangular pattern, although other geometric patterns are possible, wherein the triangular pattern is comprised of one female terminal 18 at each vertex of the triangular pattern.

Figure 5:
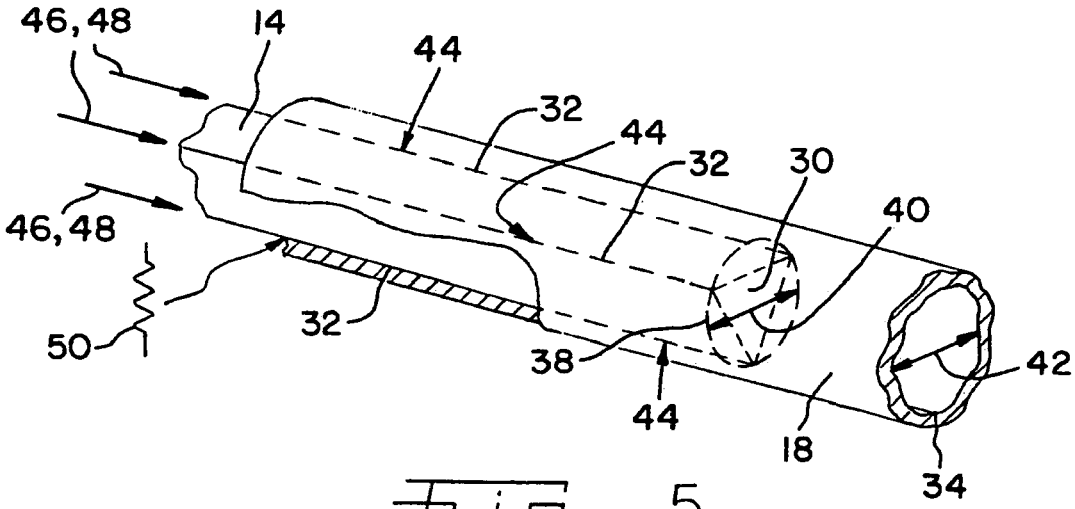
FIG. 5 is perspective fragmentary view of an embodiment of a male terminal inserted into a female terminal showing line contacts between the pair.

The approximately triangular cross-section 30, of male terminals 14, defines a circle 38 (as best shown in FIG. 5) with a first diameter 40, and the approximately circular cross-section 36 defines an inside diameter 42 which is less than first diameter 40. At least one female terminal 18 provides a spring force 44 on at least one male terminal 14 when female terminal 18 is electrically connected to male terminal 14. Spring force 44 acts radially inward relative to the approximately circular cross-section 36.

At least one line contact 32 provides at least one of a wiping action 46 and a cleaning action 48 between male terminal 14 and female terminal 18. At least one of wiping action 46 and cleaning action 48 provides a reduced contact resistance 50 between male terminal 14 and female terminal 18. That is, as male terminal 14 is inserted into (or retracted from) female terminal 18 line contacts 32, having spring force 44 acting on them through circular cross-section 36, wipe and clean the mutual contact area between male terminal 14 and female terminal. 18, thereby eliminating relatively high resistivity materials such as metal oxides and other contaminants in the mutual contact area. Further, the realistic area of contact between male terminal 14 and female terminal 18 is increased. Both of the elimination of the relatively high resistivity materials in the mutual contact area and the increase of the area of contact in the mutual contact area provide for a reduced contact resistance 50 between male terminal 14 and female terminal 18. Longitudinal split 34 in female terminal 18 allows female terminal 18 to apply an elastic spring force 44 on male terminal 14 as opposed to an inelastic deformation of the terminals.

In use, the present invention provides a method of electrically connecting an electrical terminal pair, including the steps of: providing a male terminal 14 including at least one line contact 32; splitting a female terminal 18 longitudinally (as at longitudinal split 34, for example), female terminal 18 including an approximately circular cross-section 36; and inserting male terminal 14 into female terminal 18. The method of the present invention further includes the steps of cleaning at least one line contact 32 during the inserting step and the substep of forming male terminal 14 with an approximately triangular cross-section 30.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical connector, comprising:

a first plurality of conductors;

a second plurality of conductors;

three male terminals each electrically connected to a respective one of said first plurality of conductors, each one of said male terminals including an approximately triangular cross-section defining at least one line contact and three vertexes of said approximately triangular cross-section, said three male terminals forming a triangular pattern comprised of a first male terminal at a first vertex of said triangular pattern, a second male terminal at a second vertex of said triangular pattern, and a third male terminal at a third vertex of said triangular pattern;

three female terminals each electrically connected to a respective one of said second plurality of conductors, each of said three female terminals for electrical connection to a respective one of said male terminals, each one of said female terminals including only one longitudinal split, an approximately circular cross-section, and an approximately smooth interior surface, said three female terminals forming a triangular pattern comprised of a first female terminal at a first vertex of said triangular pattern, a second female terminal at a second vertex of said triangular pattern, and a third female terminal at a third vertex of said triangular pattern, said three male terminals and said three female terminals configured for inserting said three male terminals into corresponding said three female terminals and for mating at least two said vertexes of said approximately triangular cross-section of each said male terminal with said approximately smooth interior surface of each said female terminal;

a first housing enclosing said three male terminals, said first housing including an inside contour adjacent said three male terminals; and a second housing enclosing said three female terminals, said second housing including a plurality of radial ribs complementary in shape to said inside contour.

2. The electrical connector of claim 1, wherein said approximately triangular cross-section defines a circle with a first diameter, said approximately circular cross-section defines an inside diameter less than said first diameter.

3. The electrical connector of claim 1, wherein each one of said female terminals provides a spring force on a respective one of said male terminals when a respective one of said female terminals is electrically connected to a respective one of said male terminals, said spring force acting radially inward relative to said approximately circular cross-section.

4. The electrical connector of claim 1, wherein said at least one line contact includes at least three said lines of contact.

5. The electrical connector of claim 1, wherein said at least one line contact provides at least one of a wiping action between a respective one of said male terminals and a respective one of said female terminals, and a cleaning action between a respective one of said male terminals and a respective one of said female terminals.

6. The electrical connector of claim 5, wherein said at least one of said wiping action and said cleaning action provides a reduced contact interface resistance between a respective one of said male terminals and a respective one of said female terminals.

7. The electrical connector of claim 1, wherein at least one of said first housing and said second housing includes a connector lock with a living hinge.

8. A method of electrically connecting an electrical connector pair, comprising the steps of:

providing a first plurality of conductors and a second plurality of conductors;

providing three male terminals, each one of said male terminals including an approximately triangular cross-section defining at least one line contact and three vertexes of said approximately triangular cross-section;

forming said three male terminals in a triangular pattern comprised of a first male terminal at a first vertex of said triangular pattern, a second male terminal at a second vertex of said triangular pattern, and a third male terminal at a third vertex of said triangular pattern;

connecting a respective one of said first plurality of conductors to a respective one of said male terminals;

providing three female terminals, each of said three female terminals for electrical connection to a respective one of said male terminals, each one of said female terminals including only one longitudinal split, an approximately circular cross-section and an approximately smooth interior surface;

forming said three female terminals in a triangular pattern comprised of a first female terminal at a first vertex of said triangular pattern, a second female terminal at a second vertex of said triangular pattern, and a third female terminal at a third vertex of said triangular pattern;

connecting a respective one of said second plurality of conductors to a respective one of said female terminals;

splitting each one of said female terminals longitudinally only once, each one of said female terminals including an approximately circular cross-section and an approximately smooth interior surface;

enclosing said three male terminals in a first housing, said first housing including an inside contour adjacent said three male terminals;

enclosing said three female terminals in a second housing, said second housing including a plurality of radial ribs complementary in shape to said inside contour; and inserting said three male terminals into corresponding said three female terminals at least two said vertexes of said approximately triangular cross-section of each said male terminal mating with said approximately smooth interior surface of each said female terminal.

9. The method of claim 8, further including the step of cleaning said at least one line contact during said inserting step.

10. The electrical connector of claim 1, wherein said inside contour includes a cylindrical section and a planar section.

* * * * *